United States Patent [19]

Koppl et al.

[11] 4,209,679

[45] Jun. 24, 1980

[54] ELECTRICAL SWITCH

[75] Inventors: Georg Koppl, Birr; Giovanni Pedrini; Hans Widmer, both of Zurich, all of Switzerland

[73] Assignee: BBC, Brown Boveri & Company Limited, Baden, Switzerland

[21] Appl. No.: 798,079

[22] Filed: May 18, 1977

[30] Foreign Application Priority Data

May 24, 1976 [CH] Switzerland ..... 6511/76

[51] Int. Cl.[2] ..... H01H 33/88

[52] U.S. Cl. ..... 200/148 A; 200/147 R

[58] Field of Search ..... 200/148 A, 148 R, 147 R

[56] References Cited

U.S. PATENT DOCUMENTS

| | | | |
|---|---|---|---|
| 3,902,031 | 8/1975 | McConnell | 200/148 A |
| 3,985,988 | 10/1976 | Korner et al. | 200/148 A |

*Primary Examiner*—Robert S. Macon

*Attorney, Agent, or Firm*—Burns, Doane, Swecker & Mathis

[57] ABSTRACT

An electrical switch in which during a switchoff operation the switchoff current is commuted from a continuous current path through the switch to an extinction current path which includes a pair of separable contact members one of which is located in a region of the switch housing within which a relatively low gas pressure exists, the other contact member being located within a pressure chamber in which a higher gas pressure is generated during the switchoff operation by heating the gas electrically with an auxiliary rotating arc drawn between a pair of arcing members located within the pressure chamber and which disengage during the switchoff movement. The heated and pressurized gas within the pressure chamber is discharged through a small opening in a nozzle which is opened as the contact members separate thus blasting and extinguishing the arc formed therebetween.

20 Claims, 2 Drawing Figures

ELECTRICAL SWITCH

BACKGROUND OF THE INVENTION

The invention concerns an electrical switch to switch on and off an electrical circuit by commutating a switchoff current from a continuous current path to an extinction current path, and vice versa, and the breaking or restoring respectively of the continuous current path by the relative motion between two contact members, where a first contact is arranged in region that is under a relatively low gas pressure, and a second contact is arranged in a pressure chamber which can be brought into communication with said region by way of a narrow nozzle opening and within which can be generated a higher gas pressure relative to that of said region for the purpose of quenching by blasting a main arc arising across the contacts during the switchoff.

Electrical switches of this type have been known for some time and are employed primarily as a high-voltage power circuit-breaker, a species of which is described in the Brown-Boveri "Mitteilungen," No. 4–1976, namely, a $SF_6$ high-voltage power switch type ELF for outdoor installation. This switch uses as a quenching and insulating medium sulphur hexafluoride ($SF_6$) which has been utilized with great success in many encased systems because its characteristics are very suitable for this specific purpose. This switch employs the compression piston principle where the quenching pressure, necessary for the extinction of the arc, is generated in a compression piston during the circuit-breaking movement.

The switch unit comprises a stationary contact, a moving contact driven by a switch rod with spring-actuated or pneumatic power, with the compression cylinder and the arc contacts which become functional at the time of circuit-breaking.

During the circuit-breaking operation the driven contact moves downward toward the switchoff position and the compression within the blast piston space will begin. This is followed by a separation of the continuous current contacts a commutation of the current to the arc contacts, a separation of the arc contacts and the formation of the arc across the arc contacts, followed by the blasting of the arc by the gas compressed by the blast piston and the extinction of the arc. The switchoff position is finally reached and the blasting is terminated.

The gas required for the blasting is compressed within a pressure chamber surrounding one of the drive contacts, with the compression taking place throughout the entire switch travel at decreasing compression volume and increasing resistance. The compression work must therefore be achieved externally in the form of drive energy. The generated gas pressure is therefore a burden for the drive of the switch unit and the magnitude of the differential pressure will depend on the switch travel. The volume of the pressure chamber and the motive power required are also very substantial.

SUMMARY OF THE INVENTION

The principal objective of the invention to provide an improved electric switch of the above defined general type where the gas pressure will not affect the drive, or will even facilitate the drive, and where the magnitude of the differential pressure is not controlled by the switch travel.

A switch designed by the invention to solve this problem is characterized by the features that the pressure chamber is arranged stationary relative to the second contact and that it follows its relative motion during the switchoff as well as the switchon operation, and that an electric system is arranged within the pressure chamber, its first element group being arranged stationary relative to the first contact within a first switchoff travel region and relative to the second contact within a second switchoff travel region, and its second element group being arranged stationary relative to the second contact throughout the entire switchoff travel, and that the electric system at a pre-determined switchoff travel position produces a rotating auxiliary arc which will heat the gas within the pressure chamber, thus raising the gas pressure to the magnitude necessary for the blasting and quenching of the main arc which arises primarily outside the pressure chamber.

The switch proposed by the invention offers the following advantages: The required gas pressure is not attained by mechanical compression but by electric heating, and the generation of pressure will not adversely influence the drive since it is not dependent on it. The pressure generation is also not influenced by the switch travel so that it becomes possible to regulate the magnitude of the differential pressure and the timing of the blast for optimum effects independently of the switch travel. An electric system, arranged within the pressure chamber, and containing an element group which acts at a limited length of travel, makes feasible a significant reduction in the volume of the pressure chamber. The invention results in a steep and higher rise of the gas pressure, a simplified drive mechanism and a very compact design.

In the case of a preferred species of the invention there is attained by a suitable design of the surfaces which form the boundaries of the pressure chamber an automatic compensation of the dynamic gas pressures, and thus an independence with respect to the drive, or an overcompensation of the pressures, and thus a drive-supporting effect.

BRIEF DESCRIPTION OF DRAWINGS

A practical example of the invention will be now explained in detail and is illustrated by the accompanying drawings wherein.

Figure 1:
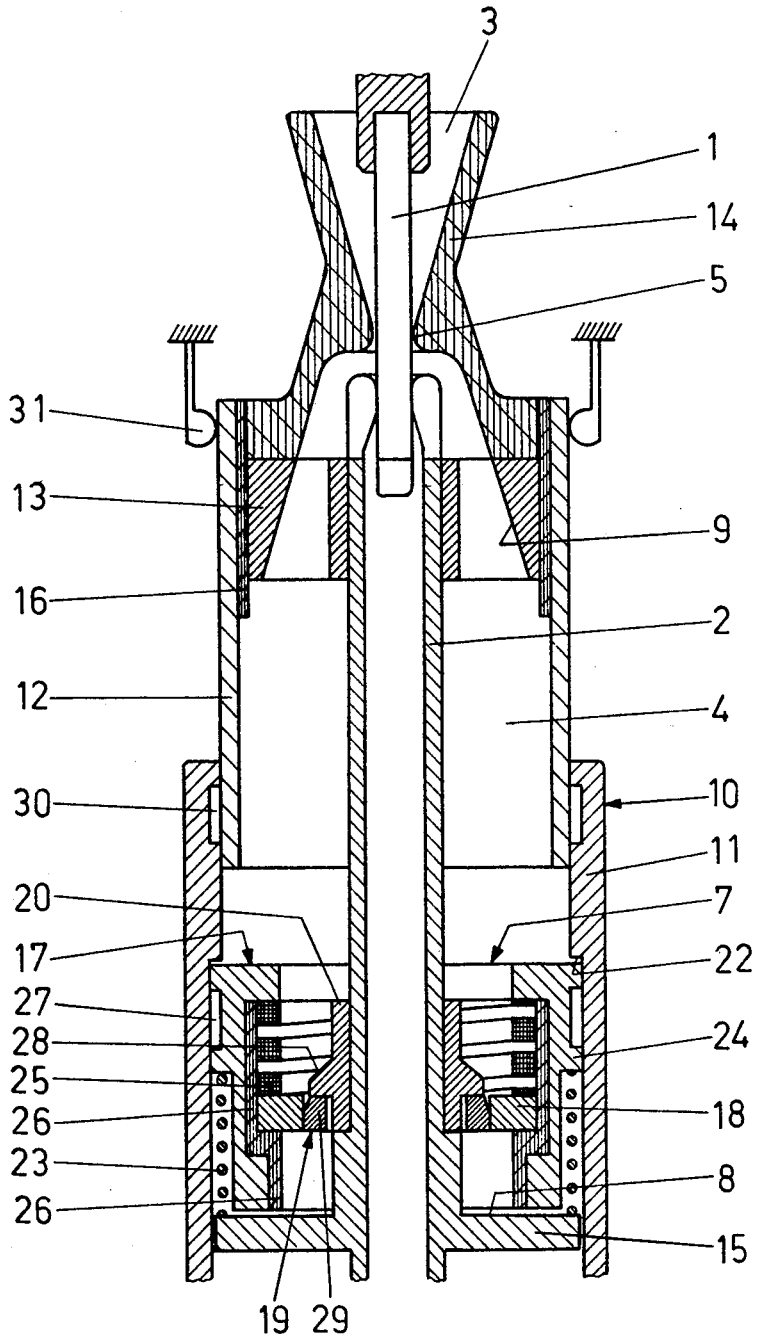
FIG. 1 shows a longitudinal cross-section of the switch mechanism of a circuit breaker in the "on" position.

The switch mechanism shown by FIG. 1 comprises a first contact member 1 which is arranged stationary relative to a—not illustrated—housing, and a second contact member 2 which can move in an axial direction relative to the first contact 1. The contact 2 is connected to a drive rod—not illustrated—which moves the contact into its switchoff and switchon positions. The stationary contact 1 is located primarily within a region 3 of the housing where a relatively low gas pressure prevails. The contact 2 however is arranged within the pressure chamber 4 which moves together with the contact 2 during the travel motions, its volume remaining constant. The pressure chamber 4 is limited in the switchoff direction by the boundary surface 8 and in the switchon direction by the opposite surface 9. These surfaces are substantially identical in projection. Substantially identical projections insure an automatic compensation of the dynamic gas pressures, and therefore the movement of the second contact member 2 is neither aided nor opposed. It is also possible to design the surfaces 8 and 9 in such a manner that the boundary surface 8 is greater in projection than the opposite surface 9. A pressure overcompensation will then be attained, and therefore the movement of the second contact member 2 will be aided or supported. Thus a drive-supporting effect will be produced when the projection of the boundary surface 8 is greater than the projection of the opposite surface 9.

The pressure chamber 4 is formed in the interior of a pressure unit 10 which comprises a stationary pressure cylinder 11 and several components which are fixedly connected with the contact 2 and which can move together with this contact relative to the pressure cylinder 11. These components comprise a commutation tube 12 which is fixedly connected with the contact 2 by way of an insulating sleeve 16 and a coupling star 13, and an insulating nozzle 14 which is fastened at the coupling star 13. This insulating nozzle 14 consists of electrically insulating material and has a narrow neck 5 through which a communication can be established between the pressure chamber 4 and the region 3. At the inner circumference of the pressure cylinder 11 there is arranged a first tubular contact slide 30 which insures a permanent electric connection between the pressure cylinder 11 and the commutation tube 12. The pressure unit 10 is limited at its lower end by the pressure piston 15 which is fixedly connected with the contact 2 and which moves within the pressure cylinder 11. The axial distance between the pressure piston 15 and the insulating nozzle 14 is not affected by the position of the movable piston so that the volume of the pressure chamber 4 will remain constant throughout the entire travel.

Within the pressure chamber 4 there is arranged an electric system 7 which delivers at a pre-determined switchoff travel position the thermal energy that is needed to raise the gas pressure within the pressure chamber 4 to a magnitude necessary for the blasting and quenching of the main arc 6. This thermal energy is produced at a pre-determined point of travel by the ignition of a rotating auxiliary arc 21 across a first arcing ring 18 of a first element group 17 and a second arcing ring 20 of a second element group 19 of the system 7, and the gas that is present within the, still closed off, pressure chamber 4 is pressurized in this manner.

The first element group 17 of the system 7 comprises a slidable sleeve 24, guided within the pressure cylinder 11 and carrying in its interior an insulating tube 26, further a coil 25 producing a transverse magnetic field, a first arcing ring 18 and finally a tubular second slidable contact 27, placed between the perimeter of the slidable sleeve 24 and the pressure cylinder 11, thus electrically connecting the pressure cylinder 11 with the element group 17.

The second element group 19 of the system 7 which follows the movements of contact 2, comprises the second arcing ring 20 with an arcing cone 28 and several arcing fingers 29, located within and protruding from the cone 28.

At the time of the "on" position of the switch, illustrated by FIG. 1, with the current flowing primarily by way of the continuous current path over the commutation contact 31, the commutation tube 12 and the pressure cylinder 11, the element groups 17 and 19 are located opposite each other. The slidable sleeve 24 rests at a stop 22 inside the pressure cylinder 11 and is held in place by means of a restoring spring 23 which is compressed in the specific position illustrated and is arranged between the pressure piston 15 and the slidable sleeve 24. The arcing ring 18 is in contact with the arcing fingers 29, and only a low partial current is flowing through the system 7.

When the switchoff travel begins, the continuous current path is interrupted because the commutation tube 12 moves away from the commutation contact 31 and the switchoff current is commutated to the extinction current path which leads through the contacts 1 and 2, the system 7 and the pressure cylinder 11. The contact 2 moves at the same time downwardly together with the element group 19 and the pressure piston 15, while the element group 17 remains stationary. The arcing fingers 29 will pass by the arcing ring 18, and a gap will form between this ring and the cone 28, functioning as a firing distance, igniting the auxiliary arc 21 (see FIG. 2).

When the arcing ring 20 reaches a position at which it opposes the arcing ring 18 at full firing distance, the commutation tube 12 has arrived at the slidable sleeve 24, moving the entire element group 17 together with the element group 19 downwardly against the pressure exerted by the restoring spring 23 which at this stage is already partially expanded. At this time the firing distance between the arcing rings 18 and 20 is effective at its maximum, and the rotating auxiliary arc 21 is fully activated. Due to the thermal influence of the burning auxiliary arc 21, the gas present within the still closed-off pressure chamber 4, is rapidly heated and pressurized.

Figure 2:
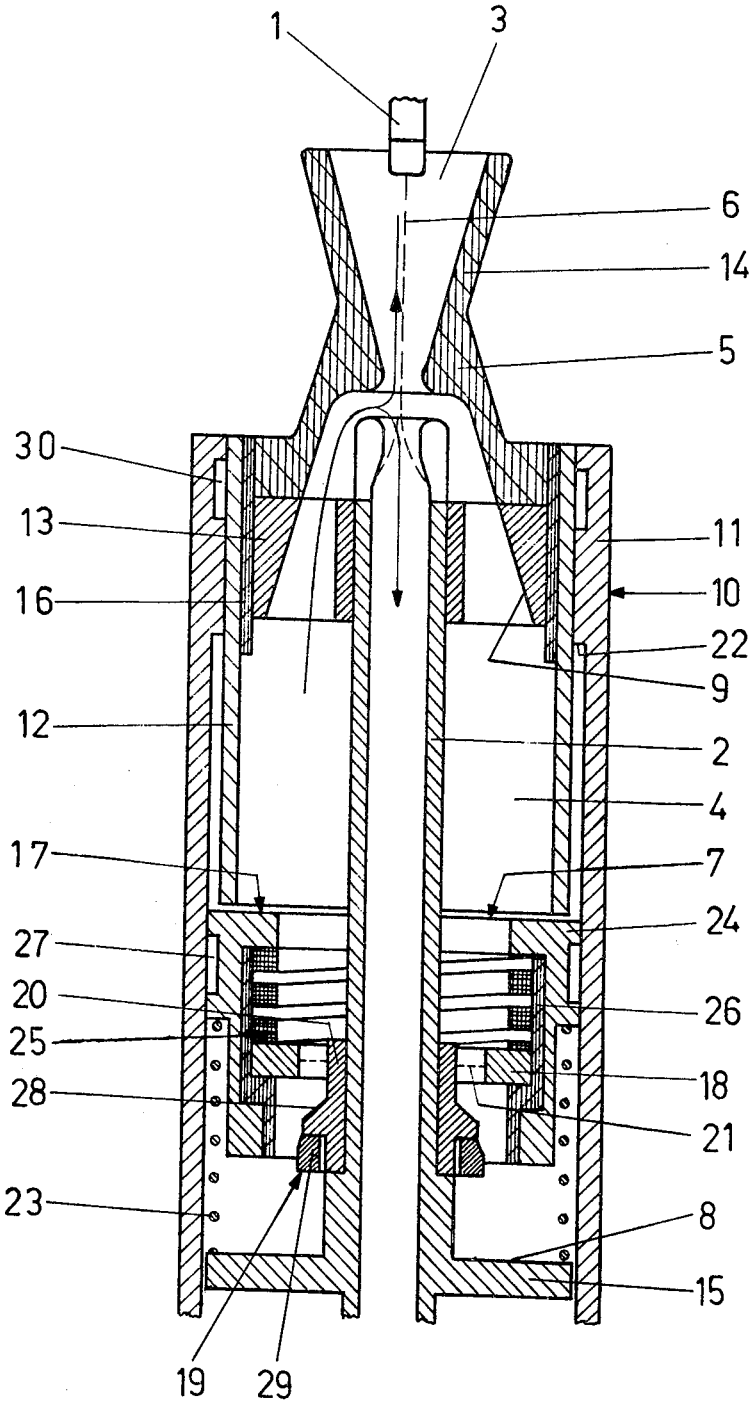
FIG. 2 shows a longitudinal cross-section of the switch mechanism shown by FIG. 1 under quenching conditions.

As the switchoff travel movement continues, contact 2 will separate from contact 1, and the main arc 6, which will lengthen gradually, is produced (see FIG. 2). At the same time the narrow neck 5 of the nozzle is opened up, thus providing a communication between the pressure chamber 4 and the region 3. The high-pressure gas within the pressure chamber 4 flows at sonic velocity through the now open neck 5 of the nozzle, blasting the main arc 6 in the axial direction and causing its extinction at the null current instant of the switchoff current. A "double blasting" effect takes place here, with the pressurized gas flowing in two opposite directions, as indicated by the arrows.

The extinction of the main arc 6 causes the interruption of the extinction current path, thereby extinguishing the auxiliary arc 21 also.

The contact 2 with the element group 19 and the pressure piston 15 as well as the commutating tube 12 with the element group 17, and thus the pressure chamber 4 will then arrive at the end position of the switchoff movement. The restoring spring 23 will remain in its partially expanded state that had been reached at the start of the movement by the element group 17.

When the final switchoff position has been reached, the entire switch travel of the moving components has ended and the complete separating and insulating distance of the continuous current path, and the extinction current path respectively, has been reached. The hot gas remaining in the pressure chamber 4 and the heated components of the switch mechanism are now cooled off quickly and the pressure chamber is filled with new gas.

The switchoff position of the switch mechanism corresponds to the initial switchon position. In order to switch on the circuit breaker, the movable elements of the switch mechanism are moved upwardy in opposite direction and in reversed order from the sequences illustrated by the drawings. Initially, the element group 17 will remain stationary for a brief period of time under the influence of the static friction of the slide contact 27, the restoring spring 23 is compressed, and the auxiliary arc contact between the arcing ring 18 and the arcing fingers 29 is closed. The element group 17 is then carried along in the switchon direction by the moving pressure piston 15. In reversal of the switchoff operation the extinction current path is closed first, before the switchon position is reached, and subsequently the continuous current path is closed, thereby completing the switchon process.

The switchon position of the switch mechanism corresponds to the initial switchoff position as depicted in FIG. 1. The continuous current path is closed. The main and the auxiliary arc contacts of the extinction current path are likewise closed. The element group 17 is kept in place by the compressed restoring spring 23 between the pressure piston 15 and the stop 22 of the pressure cylinder 11, and the arcing ring 18 is connected with the arcing cone 28 by way of the arcing fingers 29.

The embodiment of the switch which has been described has a stationary contact 1 and a movable contact 2. It is also possible to make the contact 2 stationary and the contact 1 movable, or to design the switch in such manner that both contacts 1 and 2 are movable. If such alternate solutions are used it is necessary to keep the arrangment of the above described motions of the switch components in the form of relative motions.

We claim:

1. In an electrical switch structure for switching an electrical circuit between its on and off positions by commutating a switchoff current from a continuous current path to an extinction path and vice versa and the breaking or restoring respectively of the continuous current path by relative movement between two contact members, wherein a first one of said contact members is located within a gas filled switch housing in a zone that is subjected to a relatively low gas pressure and the second contact member is located within a pressure chamber which can be brought into communication with said low pressure zone by way of a narrow opening in a nozzle and within which a pressure higher than that within said low pressure zone can be generated for the purpose of quenching by means of a blast action the main arc arising across said contact members during a switchoff operation, the improvement wherein said pressure chamber remains stationary in relation to said second contact member and follows movement of said second contact member during both the switchoff and switchon operations, wherein an electric system is located within said pressure chamber and comprises first and second element groups, said first group including a first arcing member and being stationary in relation to said first contact member within a first switchoff travel zone and stationary in relation to said second contact member within a second switchoff travel zone, and said second group including a second arcing member and being stationary in relation to said second contact member throughout the entire switchoff travel movement, said first and second arcing members producing between them a rotating auxiliary arc effecting a heating of the gas within said pressure chamber and raising its pressure to a level effective to blast and quench said main arc.

2. An electrical switch structure as defined in claim 1 wherein the volume of said pressure chamber remains at least substantially constant throughout the entire switchoff travel movement.

3. An electrical switch structure as defined in claim 1 wherein one boundary surface which limits said pressure chamber in the switchoff direction corresponds in projection at least substantially to an opposite surface which limits the pressure chamber in the switchon direction.

4. An electrical switch structure as defined in claim 1 wherein one boundary surface which limits said pressure chamber in the switchoff direction is in projection larger than an opposite surface which limits the pressure chamber in the switchon direction.

5. An electrical switch structure as defined in claim 1 wherein said pressure chamber is formed by the interior of a pressure unit and in which are contained said first element group which is stationary in relation to said first contact member and said second element group that is stationary in relation to said second contact member.

6. An electrical switch structure as defined in claim 5 wherein said first element group comprises a pressure cylinder and a tubular first contact slide engaged with the inner periphery of said cylinder and wherein said second element group comprises a commutation tube movable within said cylinder and electrically connected to it by means of said contact slide, a coupling star connecting said commutation tube to said second contact member by means of an insulation sleeve interposed therebetween, said nozzle being made from insulating material and secured to said coupling star, and a pressure piston secured to said second contact member and which is movable within said pressure cylinder.

7. An electrical switch structure as defined in claim 6 wherein said first element group further includes a sleeve slidable within said pressure cylinder, an insulating tube within said sleeve, and a coil within said insulating tube and which produces a transverse magnetic field, said first arcing member having a ring-shaped configuration and a tubular second contact slide located between said sleeve and said pressure cylinder.

8. An electrical switch structure as defined in claim 1 wherein said second arcing member of said second element group has a ring-shaped configuration establishing an adjacent arcing cone portion provided with a plurality of arcing fingers.

9. An electrical switch structure as defined in claim 6 wherein when said switch occupies its switchon position said first and second contact members are engaged and said first and second element groups are electrically connected by way of their respective first and second arcing members, and wherein the current flows principally through a continuous current path which includes a commutation contact engaged with said commutation tube which in turn is electrically connected to said pressure cylinder by said contact slide.

10. An electrical switch structure as defined in claim 9 wherein when said switch occupies its switchon position said first element group which is stationary in relation to said first contact member rests at a stop located inside said pressure cylinder and is held in that position by a restoring spring located between said pressure piston and said first element group and being in its compressed state.

11. An electrical switch structure as defined in claim 9 wherein said first arcing member has a ring-shaped configuration and wherein said second arcing member surrounds said second contact member and includes a ring-shaped portion which merges into a cone portion with arcing fingers adjacent thereto for connection of said fingers with said first arcing member when said switch occupies its switchon position.

12. An electrical switch structure as defined in claim 9 wherein at the beginning of movement of said commutation tube in the switchoff direction said tube is separated from said commutation contact whereby the current is commuted from the continuous current path to the extinction current path which extends through the still connected first and second contact members, said electric system and said pressure cylinder, and wherein at the same time said second contact member together with said second element group and said pressure piston execute a relative motion in the switchoff direction pertaining to said first element group which is still stationary relative to said first contact member, whereby the electrical connection between said first and second element groups is broken and a rotating auxiliary arc is ignited across a gap between said first and second arcing members which gradually lengthens and functions as a firing distance.

13. An electrical switch structure as defined in claim 12 wherein when said switch occupies its switchon position said first element group which is stationary in relation to said first contact member rests at a stop located inside said pressure cylinder and is held in that position by a restoring spring located between said pressure piston and said first element group and being in its compressed state.

14. An electrical switch structure as defined in claim 13 wherein at a switchoff travel position when the full firing distance between said first and second element groups is operative, said commutation tube engages said first element group which has remained stationary up to this time and moves said first element group together with said second element group in the switchoff direction against the pressure exerted by the already partially released restoring spring whereby the rotating auxiliary arc burns at maximum strength thus heating and pressurizing the gas inside said pressure chamber which is still closed off.

15. An electrical switch structure as defined in claim 11 wherein during a switchoff operation said ring-shaped first arcing member is separated from the arcing fingers of said second arcing member to establish a gradually increasing firing distance with respect to the cone portion thereof and wherein the full firing distance is formed when said ring-shaped portion of said second arcing member is opposite said right-shaped first arcing member.

16. An electrical switch structure as defined in claim 14 wherein after ignition of said rotating auxiliary arc said first and second contact members separate and form a main arc therebetween which gradually lengthens, wherein said narrow opening in said nozzle is then opened and the pressurized gas within said pressure chamber flows through said nozzle opening at sonic velocity and extinguishes said main arc at the null-current instant of the switchoff current, and wherein extinction of said main arc results in an interruption of said extinction current path and extinction of said auxiliary arc whereupon said second contact member together with said second element group and said pressure chamber reach the end position of the switchoff travel movement.

17. An electrical switch structure as defined in claim 10 wherein within a first switchoff travel zone a partial release of said restoring spring takes place and said spring reaches the end position of the switchoff movement in a partially released state.

18. An electrical switch structure as defined in claim 1 wherein said first contact member remains stationary within the switch housing and said second contact member is movable in the axial direction of the housing.

19. An electrical switch structure as defined in claim 1 wherein said second contact member remains stationary within the switch housing and said first contact member is movable in the axial direction of the housing.

20. An electrical switch structure as defined in claim 1 wherein said first contact member and said second contact member are movable in the axial direction of the switch housing.

* * * * *